US009679516B2

(12) United States Patent
Chung et al.

(10) Patent No.: US 9,679,516 B2
(45) Date of Patent: Jun. 13, 2017

(54) ORGANIC LIGHT EMITTING DISPLAY AND METHOD FOR DRIVING THE SAME

(71) Applicant: SAMSUNG DISPLAY CO., LTD., Yongin, Gyeonggi-Do (KR)

(72) Inventors: Bo Yong Chung, Suwon-si (KR); Dong Gyu Kim, Yongin-si (KR); Hai Jung In, Seoul (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 119 days.

(21) Appl. No.: 14/693,161

(22) Filed: Apr. 22, 2015

(65) Prior Publication Data

US 2016/0104419 A1 Apr. 14, 2016

(30) Foreign Application Priority Data

Oct. 13, 2014 (KR) ..... 10-2014-0137706

(51) Int. Cl.
*G09G 3/30* (2006.01)
*G09G 3/3225* (2016.01)

(52) U.S. Cl.
CPC ... *G09G 3/3225* (2013.01); *G09G 2300/0814* (2013.01); *G09G 2300/0819* (2013.01); *G09G 2320/0233* (2013.01); *G09G 2320/045* (2013.01); *G09G 2330/12* (2013.01)

(58) Field of Classification Search
CPC ..... G09G 3/3225; G09G 2330/12; G09G 2320/045; G09G 2300/0819; G09G 2320/0233; G09G 2300/0814; G09G 3/3233
See application file for complete search history.

(56) References Cited

U.S. PATENT DOCUMENTS 8,072,396 B2 * 12/2011 Kitazawa ..... G09G 3/3233 315/169.3
8,599,114 B2 * 12/2013 Kim ..... G09G 3/3233 345/211
8,830,219 B2 * 9/2014 Choi ..... G09G 3/3233 345/211
9,159,263 B2 * 10/2015 Choi ..... G09G 3/3225
9,299,319 B2 * 3/2016 Han ..... G09G 5/10
(Continued)

FOREIGN PATENT DOCUMENTS

KR 10-2006-0092716 A 8/2006
KR 10-0902245 B1 6/2009
KR 10-2011-0028752 A 3/2011

*Primary Examiner* — Rodney Amadiz
(74) *Attorney, Agent, or Firm* — Lee & Morse P.C.

(57) ABSTRACT

A pixel of an organic light emitting display includes first through fourth transistors and a capacitor. The first transistor operates based on a scan signal and is connected between a data line and a first node. The capacitor is connected between the first node and a second node. The second transistor operates based on a gate signal and is connected between a first power voltage and a third node. The third transistor operates based on compensation control line signal and is connected between the second node and the third node. The fourth transistor operates based on sensing control line signal and is connected between the data line and the third node. The organic light emitting element is connected between the third node and a second power voltage.

20 Claims, 11 Drawing Sheets

(56) References Cited

U.S. PATENT DOCUMENTS

| | | | | |
|---|---|---|---|---|
| 2009/0051628 | A1* | 2/2009 | Kwon | G09G 3/3233 345/77 |
| 2009/0115770 | A1 | 5/2009 | Lee | |
| 2014/0139505 | A1* | 5/2014 | Han | H04N 13/0438 345/212 |
| 2015/0187273 | A1* | 7/2015 | Chang | G09G 3/3233 345/690 |
| 2015/0348464 | A1* | 12/2015 | In | G09G 3/2022 345/205 |
| 2016/0148571 | A1* | 5/2016 | Cho | G09G 3/3266 345/212 |

* cited by examiner

ORGANIC LIGHT EMITTING DISPLAY AND METHOD FOR DRIVING THE SAME

CROSS-REFERENCE TO RELATED APPLICATION

Korean Patent Application No. 10-2014-0137706, filed on Oct. 13, 2014, and entitled, "Organic Light Emitting Display and Method for Driving the Same," is incorporated by reference herein in its entirety.

BACKGROUND

1. Field

One or more embodiments described herein relate to an organic light emitting display and a method for driving an organic light emitting display.

2. Description of the Related Art

Various kinds of flat panel displays have been developed. Examples include a liquid crystal display, a field emission display, a plasma display panel, or an organic light emitting display. An organic light emitting display generates images using organic light emitting elements that generate light based on a recombination of electrons and holes in an emission layer. Such a display has a relatively high response speed and low power consumption.

Each pixel circuit of an organic light emitting display controls the driving current that flows from a first power voltage ELVDD through an organic light emitting element. The amount of driving current is controlled by a drive transistors based on an applied data voltage.

However, the drive transistors of different pixels may have different threshold voltages, charge mobilities, and/or other characteristics. Thus, even if the same data voltage is applied to these pixels, the luminance of light emitted from the pixels may be different. Also, it has been shown that the organic light emitting element in each pixel may deteriorate over time. As a result, the characteristics of the organic light emitting element may change. For example, luminance may reduce over time for a same data voltage. These and other effects may degrade display quality.

SUMMARY

In accordance with one or more embodiments, an organic light emitting display includes a first transistor including a gate electrode connected to a scan line, a first electrode connected to a data line, and a second electrode connected to a first node; a first capacitor including a first electrode connected to the first node and a second electrode connected to a second node; a second transistor including a gate electrode connected to the second node, a first electrode connected to a first power voltage, and a second electrode connected to a third node; a third transistor including a gate electrode connected to a compensation control line, a first electrode connected to the second node, and a second electrode connected to the third node; a fourth transistor including a gate electrode connected to a sensing control line, a first electrode connected to the data line, and a second electrode connected to the third node; and an organic light emitting element including an anode electrode connected to the third node and a cathode electrode connected to a second power voltage.

The display may operate based on unit frame period which includes a first compensation period in which the third transistor is turned on to compensate a threshold voltage of a second drive transistor, and a second compensation period in which the fourth transistor is turned on to generate compensated data through sensing of drive information of the second transistor based on a sensing voltage of a predetermined level.

The drive information of the second transistor may be generated by sinking sensing current formed in the second transistor based on the sensing voltage through the data line, and measuring a voltage on the data line. The drive information of the second transistor may be generated by directly measuring sensing current formed in the second transistor based on the sensing voltage.

The second node may be charged to a voltage based on a difference between the threshold voltage of the second transistor and the first power voltage during the first compensation period, and the first capacitor may be charged to a voltage based on a difference between a sustain voltage from the data line and the voltage of second node.

The unit frame period may include a reset period in which the first power voltage is set to a low-level voltage and a voltage level of the third node is reset by the low-level voltage; a data input period in which a data voltage according to the compensated data is input; and a light emitting period in which the organic light emitting element emits light according to the input data. The display may include a sensor to sense the drive information of the second transistor and to generate the compensated data; and a controller to compensate for image data based on data from the sensor.

The display may include a first pixel group that includes a plurality of pixels including two pixels, wherein each of the two pixels includes at least the first transistor, the first capacitor, the second transistor, the third transistor, and the organic light emitting element, the fourth transistor may be in any one pixel of the first pixel group, and a number of pixels in the first pixel group may share the fourth transistor.

The display may operate based on one unit frame which includes a first compensation period in which the third transistor is turned on to compensate for a threshold voltage of a second drive transistor, and the fourth transistor is turned on to generate compensated data through measurement of a voltage of the third node. The unit frame period may include a reset period in which an initialization voltage is applied to the data line, and the fourth transistor may be turned on to reset a voltage of the third node.

In accordance with one or more other embodiments, an organic light emitting display includes a first transistor including a gate electrode connected to a scan line, a first electrode connected to a data line, and a second electrode connected to a first node; a first capacitor including a first electrode connected to the first node and a second electrode connected to a second node; a second transistor including a gate electrode connected to the second node, a first electrode connected to a first power voltage, and a second electrode connected to a third node; a third transistor including a gate electrode connected to a compensation control line, a first electrode connected to the second node, and a second electrode connected to the third node; a fourth transistor including a gate electrode connected to a sensing control line, a first electrode connected to the third node, and a second electrode connected to a sensing line; and an organic light emitting element including an anode electrode connected to the third node and a cathode electrode connected to a second power voltage.

The display may operates based on one unit frame period which includes a first compensation period in which the third transistor is turned on to compensate for a threshold voltage of a second drive transistor, and a second compensation period in which the fourth transistor is turned on to generate compensated data through sensing drive information of the second transistor based on a sensing voltage of a predetermined level. The drive information of the second transistor may be generated by sinking drive current formed in the second transistor through the sensing line based on the sensing voltage, and measuring a voltage formed on the sensing line.

The display may include a first pixel group including a plurality of pixels including two pixels, wherein each of the two pixels includes at least the first transistor, the first capacitor, the second transistor, the third transistor, and the organic light emitting element, wherein the fourth transistor is in any one pixel of the first pixel group, and wherein a number of pixels of the first pixel group share the fourth transistor.

In accordance with one or more other embodiments, a method drives an organic light emitting display. The display includes a plurality of pixels, each of the pixels including a first node to which a data voltage is applied through a switching transistor that is turned on by a scan signal of a gate-on voltage, a third node connected to an anode electrode of an organic light emitting element, a second node connected to a gate electrode of a drive transistor that controls drive current transferred from a first power voltage to the third node, and a first capacitor connected between the first node and the second node. The method includes initializing a voltage of the third node; compensating a threshold voltage of the drive transistor by connecting the third node to the second node; applying a sensing voltage to the first node and sensing drive information of the drive transistor based on sensing current formed at the third node by the sensing voltage; and applying a data voltage according to compensated image data in which the sensed drive information is reflected, wherein the organic light emitting element emits light based on the applied data voltage.

Compensating the threshold voltage of the drive transistor may includes charging the second node to a voltage which corresponds to a difference between the threshold voltage of the second transistor and the first power voltage, and charging a voltage in the first capacitor which corresponds to a voltage difference between a sustain voltage from the data line and the voltage charged to the second node. Compensating the threshold voltage of the drive transistor may include generating compensated data based on the voltage of the third node.

Initializing the voltage of the third node may include connecting the third node to a line to which an initialization voltage is applied, and discharging the voltage of the third node to the line. The method may include supplying the sensing voltage through a data line to which the data voltage is applied. The method may include supplying the sensing voltage through a sensing line different from a data line to which the data voltage is applied.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
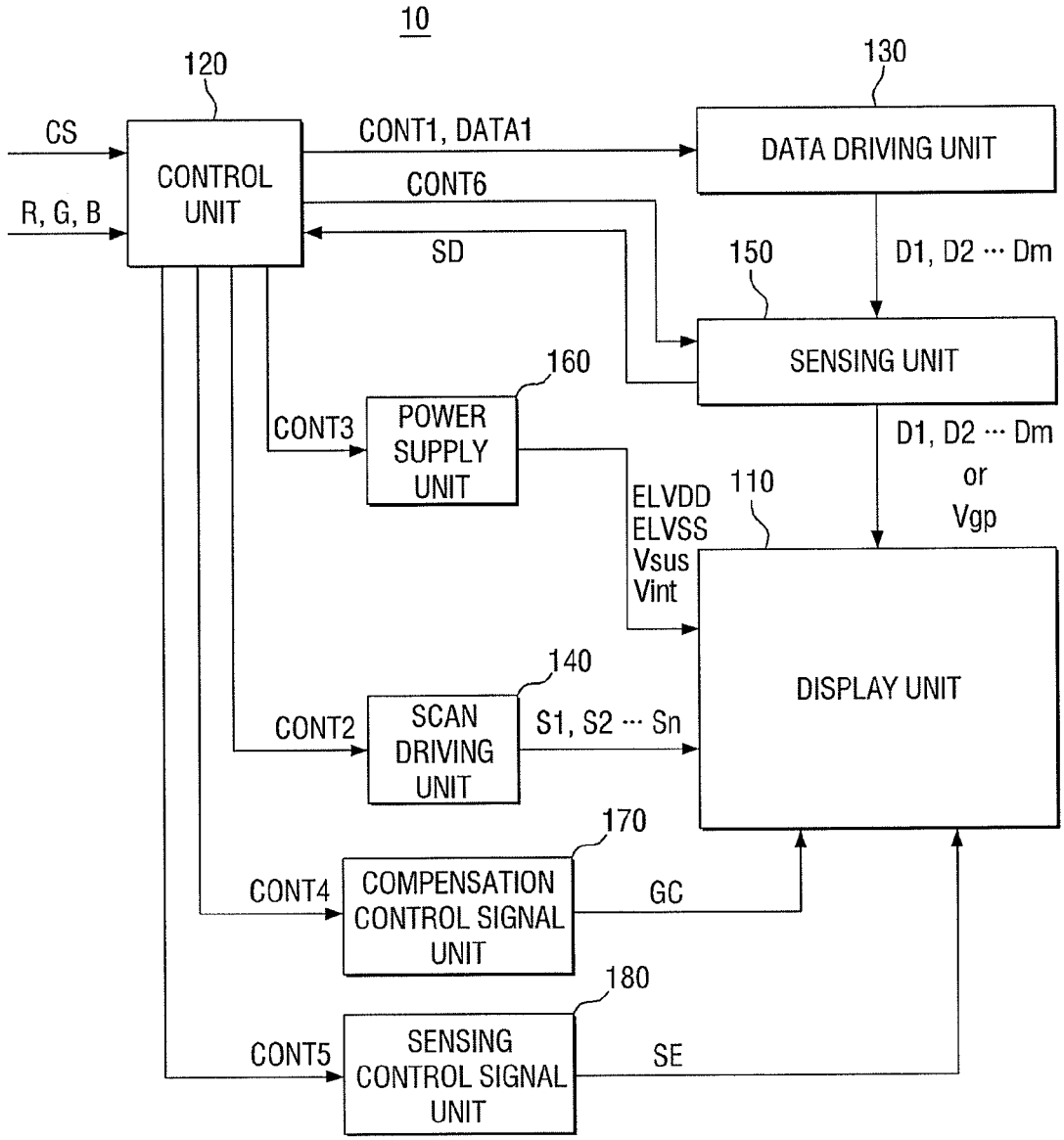
FIG. 1 illustrates an embodiment of an organic light emitting display.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout. The embodiments may be combined to form additional embodiments.

Figure 2:
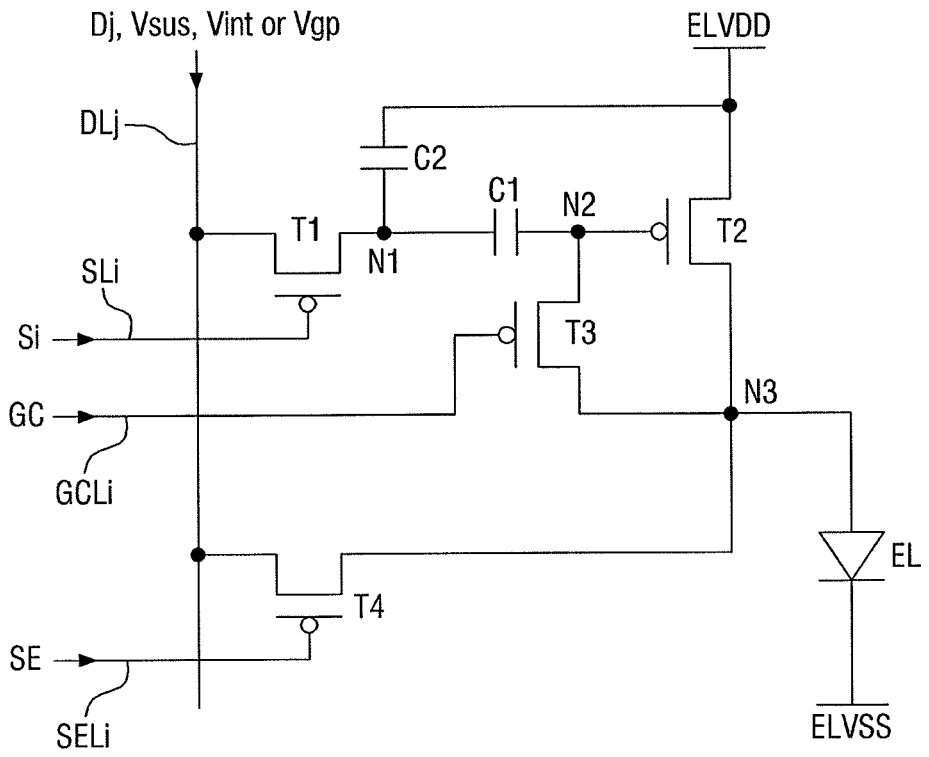
FIG. 2 illustrates an embodiment of a pixel.

FIG. 1 illustrates an embodiment of an organic light emitting display 10, and FIG. 2 illustrates an embodiment of a pixel. Referring to FIGS. 1 and 2, the organic light emitting display 10 includes a display unit 110, a control unit 120, a data driving unit 130, a scan driving unit 140, a sensing unit 150, a power supply unit 160, a compensation control signal unit 170, and a sensing control signal unit 180.

The display unit 110 displays an image using a plurality of data lines that cross a plurality of scan lines. A plurality of pixels PX are located, for example, at crossing areas of the scan lines and data lines. The pixels PX may be arranged in a matrix form. The data lines may extend in a row direction and the scan lines in a column direction. The display unit may further include a plurality of power lines, a plurality of compensation control lines, and a plurality of sensing control lines. The power lines, the compensation control lines, and the sensing control lines may be connected to the respective corresponding pixels.

The control unit 120 may receive a control signal CS and a image signal R, G, and B, for example, from an external system. The image signal R, G, and B includes luminance information for the pixels PX. Luminance may be expressed as gray levels in a predetermined range, for example, 1024, 256, or 64 gray levels may be included in the range. The control signal CS may include a vertical sync signal Vsync, a horizontal sync signal Hsync, a data enable signal DE, and a clock signal CLK. The control unit 120 may generate first to sixth drive control signals CONT1 to CONT6 and image data DATA according to the image signal R, G, and B and the control signal CS.

The control unit 120 may generate the image data DATA by dividing the image signal R, G, and B in the unit of a frame according to the vertical sync signal Vsync and dividing the image signal R, G, and B in the unit of a scan line according to the horizontal sync signal Hsync. The control unit 120 may compensate for the image data DATA, and may transfer the compensated image data DATA1 to the data driving unit 130 together with the first drive control signals CONT1. The control unit 120 may transfer the second drive control signal CONT2 to the scan driving unit 140, and may transfer the third drive control signal CONT3 to the power supply unit 150. Further, the control unit 120 may transfer the fourth drive control signal CONT4 to the compensation control signal unit 170, may transfer the fifth drive control signal CONT5 to the sensing control signal unit 180, and may transfer the sixth drive control signal CONT6 to the sensing unit 150.

The scan driving unit 140 may be connected to the scan lines of the display unit 110 in order to generate a plurality of scan signals S1 to Sn based on the second drive control signal CONT2. The scan driving unit 140 may successively apply the scan signals S1 to Sn of gate-on voltage to the scan lines.

The data driving unit 130 may be connected to the data lines of the display unit 110 to sample and hold the input compensated image data DATA1 based on the first drive control signal CONT1, and to generate a plurality of data voltages D1 to Dm based on a conversion of the image data into analog voltages. The data driving unit 130 may transfer the data voltages D1 to Dm to the data lines, respectively. The pixels PX may be turned on by the scan signals S1 to Sn of the gate-on voltage and may receive the data voltages D1 to Dm. The data voltages D1 to Dm of the data driving unit 130 may be provided to the display unit 110 through the sensing unit 150.

The sensing unit 150 may generate a sensing voltage Vgp of a predetermined level according to the sixth drive control signal CONTE, and may supply the sensing voltage to the pixels PX. The sensing voltage Vgp may drive an organic light emitting element EL in each pixel PX at a predetermined gray level. The sensing unit 150 may provide the sensing voltage Vgp to the data lines, e.g., the sensing voltage Vgp may be provided to each pixel through the data line. When the sensing unit 150 provides the sensing voltage Vgp, connections between wirings for outputting the data voltages D1 to Dm and the data lines may be intercepted.

The power supply unit 160 may determine the levels of the first power voltage ELVDD and a second power voltage ELVSS based on the third drive control signal CONT3. The first and second power voltages ELVDD and ELVSS are supplied to a plurality of power supply lines connected to the pixels. The first power voltage ELVDD and the second power voltage ELVSS may create drive current for each of the respective pixels PX.

Further, the power supply unit 160 may provide a sustain voltage Vss of a predetermined level and an initialization voltage Vint to the pixels. The sustain voltage Vss and the initialization voltage Vint may be provided to the pixels, for example, through the data lines or other signal lines. For example, in one embodiment, the display unit 110 may include wiring lines to provide the sustain voltage Vss and the initialization voltage Vint.

The compensation control signal unit 170 may determine the level of a compensation control signal CG based on the fourth drive control signal CONT4, and may provide the compensation control signal to the compensation control lines connected to the pixels. The compensation control signal unit 170 may simultaneously apply the compensation control signal CG, for example, to the connected compensation control lines. In another embodiment, the compensation control signal unit 170 may successively provide the compensation control signal CG to the compensation control lines.

The sensing control signal unit 180 may determine the levels of sensing control signals SE1 to SEn based on the fifth drive control signal CONT5, and may provide the sensing control signals to sensing control lines connected to the pixels. The sensing control signal unit 180 may successively provide the sensing control signals SE1 to SEn to the sensing control lines.

FIG. 2 illustrates an embodiment of a pixel PX, which, for example, may correspond to the pixels in the display unit 110. For illustrative purposes only, FIG. 2 illustrates the pixel PX as connected to the i-th scan line SLi and the j-th data line DLj.

Referring to FIG. 2, the pixel PX includes a first transistor T1, a second transistor T2, a third transistor T3, a fourth transistor T4, a first capacitor C1, and an organic light emitting element EL. The first transistor T1 includes a gate electrode connected to the scan line SLi, one electrode connected to the data line DLj, and the other electrode connected to a first node N1. The first transistor T1 is turned on by the scan signal Si of the gate-on voltage applied to the scan line SLi, in order to transfer the data voltage Dj applied to the data line DLj to the first node N1. The first transistor T1 may be a switching transistor that selectively provides the data voltage Dj to the drive transistor. The first transistor T1 may be, for example, a p-channel field effect transistor. Thus, the first transistor T1 may be turned on by a scan signal having a low-level voltage and may be turned off by a scan signal having a high-level voltage.

The second transistor T2 includes a gate electrode connected to a second node N2, one electrode connected to the first power voltage ELVDD, and another electrode connected to a third node N3. The first capacitor C1 is connected between the second node N2 and the first node N1, e.g., the first capacitor C1 has one electrode connected to the first node N1 and another electrode connected to the second node N2. The anode electrode of the organic light emitting element EL is connected to the third node N3. The second transistor T2 is a drive transistor for controlling drive current supplied from the first power voltage ELVDD to the organic light emitting element EL based on the voltage of the second node N2.

The third transistor T3 includes a gate electrode connected to a compensation control line GCLi, one electrode connected to the second node, and another electrode connected to the third node. The third transistor T3 is turned on by the compensation control signal GCi of the gate-on voltage applied to the compensation control line GCLi. When the third transistor T3 is turned on, the second transistor T2 is placed in a diode-connected state. The third transistor T3 is a compensation transistor that is turned on in a first compensation period to compensate for the threshold voltage of drive transistor T2.

The fourth transistor T4 includes a gate electrode connected to a sensing control line SELi, one electrode connected to the data line, and another electrode connected to the third node. The fourth transistor T4 is a sensing transistor that is turned on in a second compensation period for the purpose of measuring the drive voltage of the drive transistor T2. When the fourth transistor T4 is turned on, the j-th data line DLj may be equipotential to the drive transistor T2 and the current drive voltage of the drive transistor T2 may be measured through the j-th data line DLj.

The organic light emitting element EL includes an anode electrode connected to the third node N3, a cathode electrode connected to the second power voltage ELVSS, and an organic light emitting layer between the anode and cathode electrodes. The organic light emitting layer emit lights, for example, of one or more primary color or white. The primary colors may be, for example, three primary colors of red, green, and blue. A desired color may be displayed through a spatial or temporal sum of the three primary colors. The organic light emitting layer may include, for example, small molecule organic materials or polymer organic materials. The organic materials emit color or white light based on the amount of current flowing through the organic light emitting layer.

Figure 3:
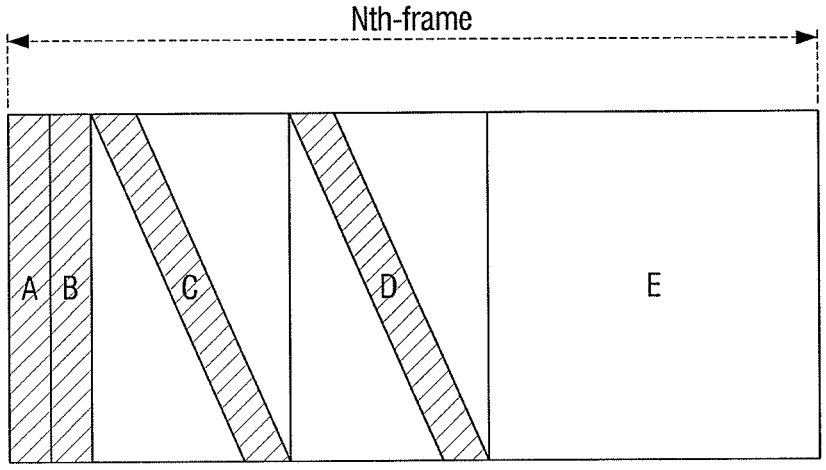
FIG. 3 illustrates an example of a frame for driving the display.
Figure 4:
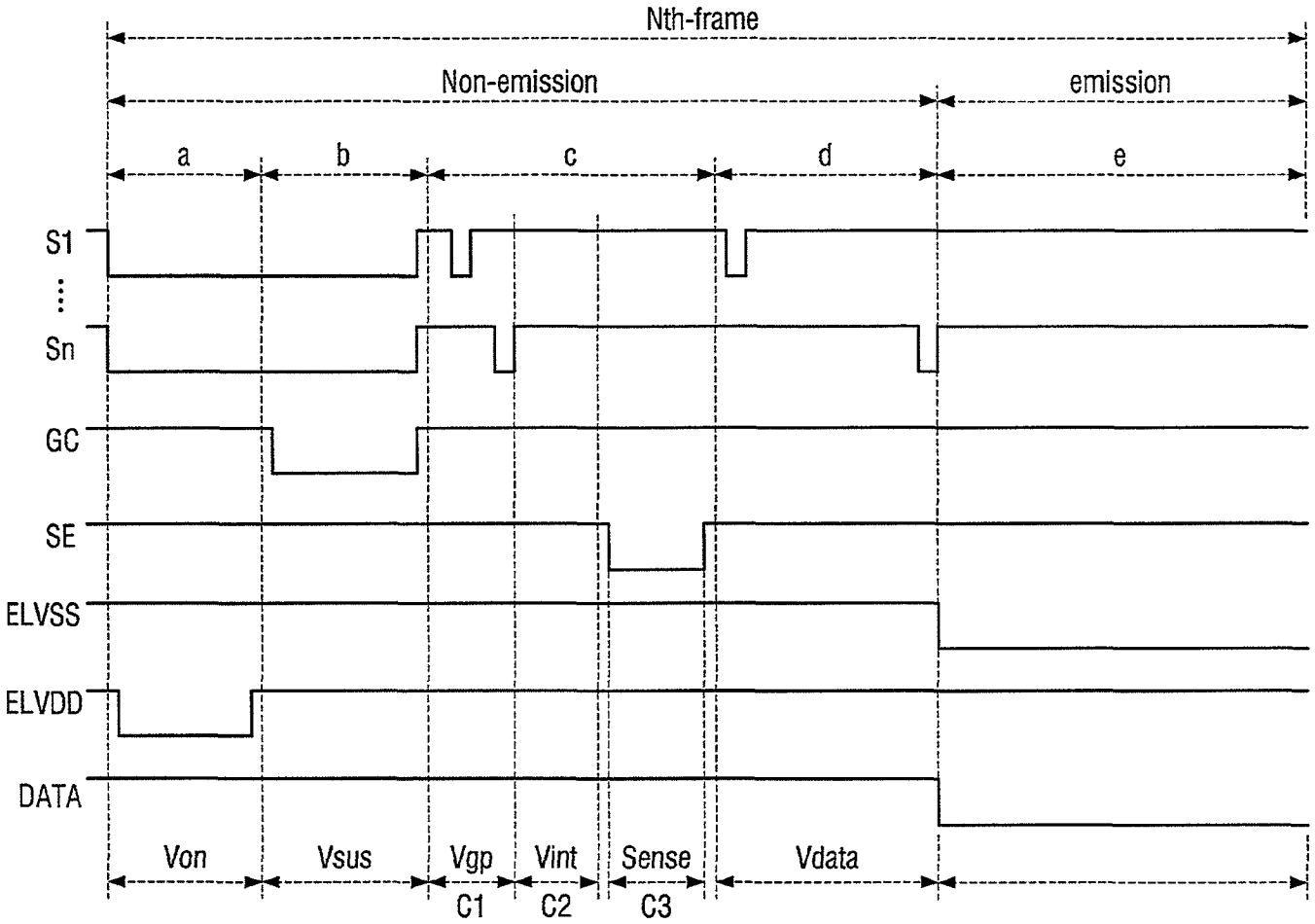
FIG. 4 illustrates an example of control signals for the display.
Figure 5:
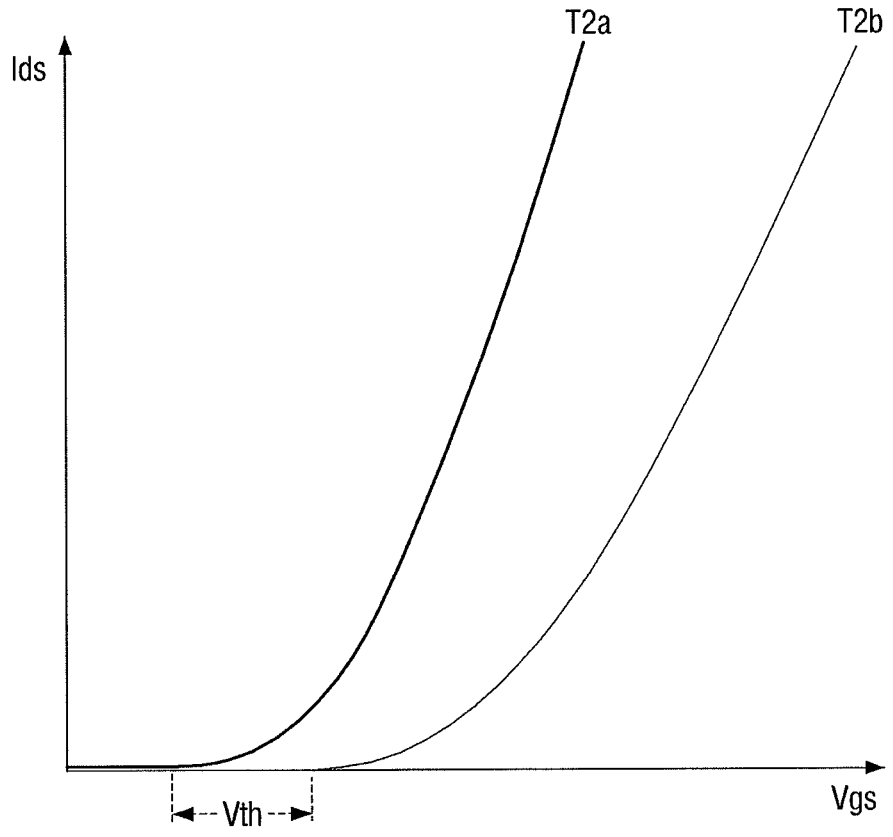
FIGS. 5 to 7 illustrate embodiments of a compensation operation.
Figure 6:
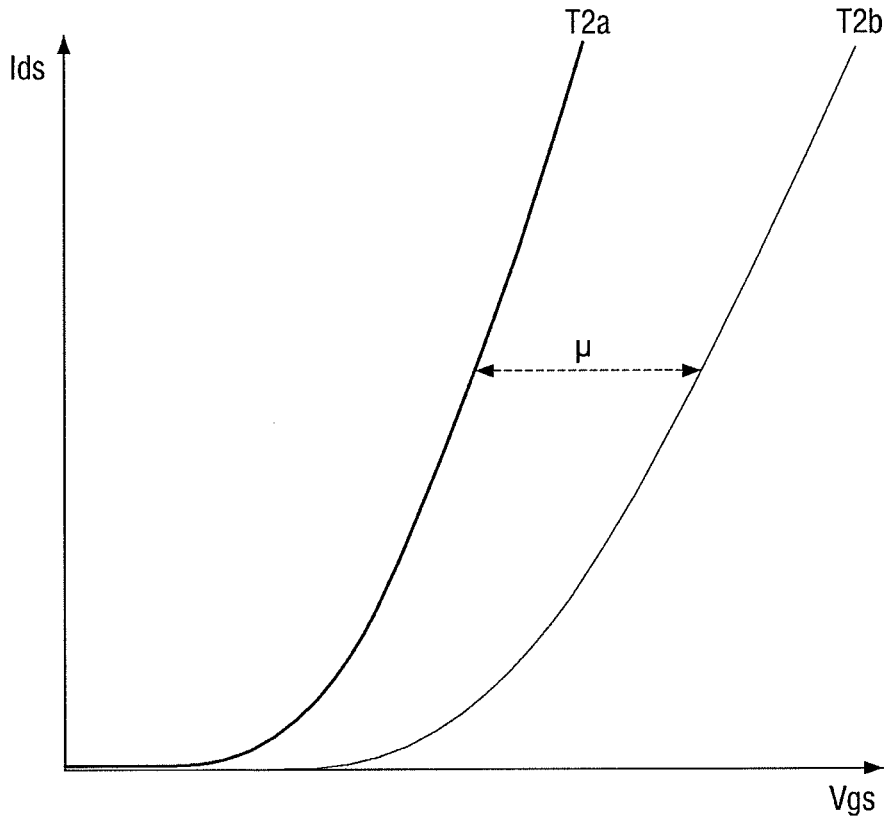
Figure 7:
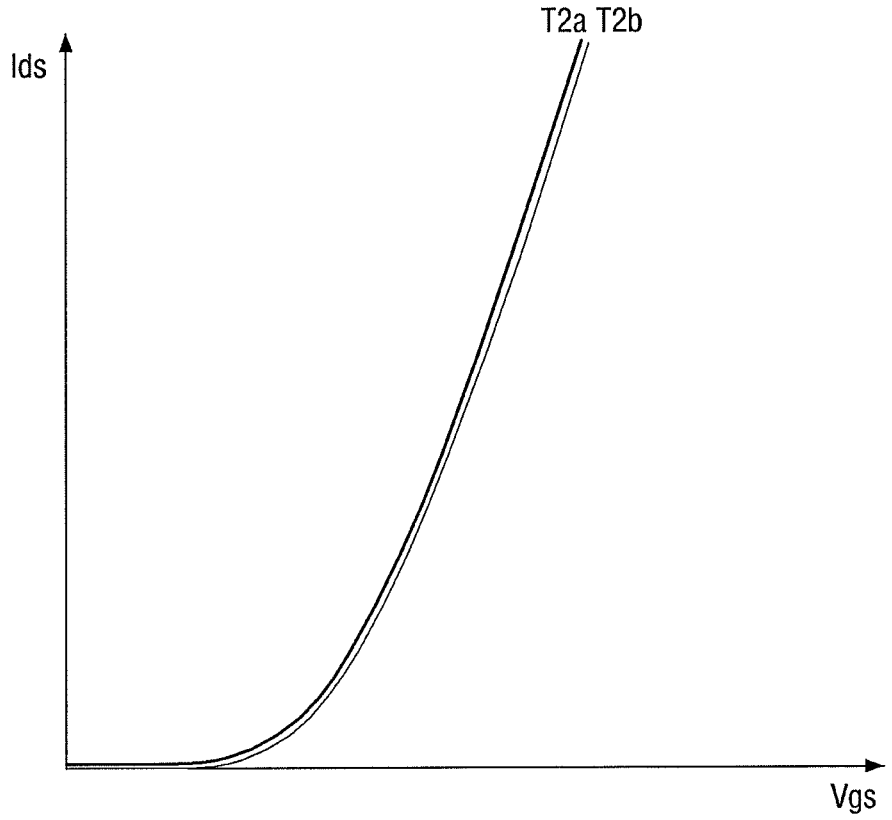
Figure 8:
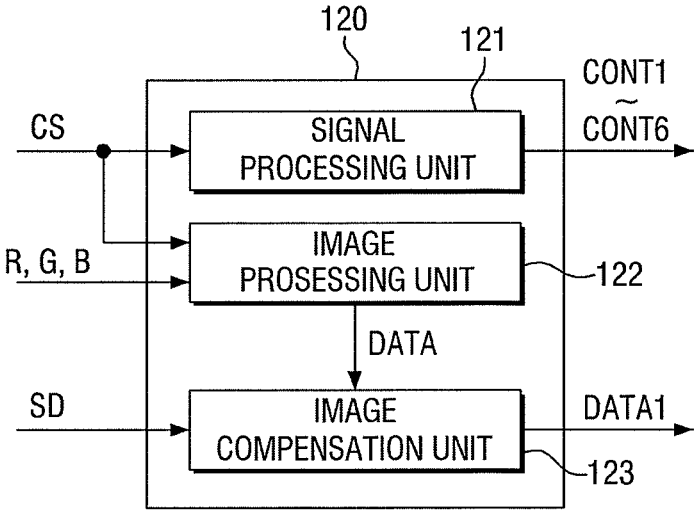
FIG. 8 illustrates an embodiment of a control unit.

FIG. 3 illustrates an example of a frame for driving the organic light emitting display 10, FIG. 4 is a timing diagram illustrating examples of control signals for driving the organic light emitting display 10, FIGS. 5 to 7 are graphs illustrating embodiments of a compensation operation, and FIG. 8 illustrates an embodiment of a control unit.

Referring to FIGS. 3 and 4, the organic light emitting display 10 operates in one frame period. The one frame period may correspond to a period in which one image is displayed on the display unit 110.

The one frame period may include, for example, a reset period A, a first compensation period B, a second compensation period C, a data input period D, and a light emitting period E. The reset period A may be a period in which the drive voltage of the organic light emitting element is reset. The first compensation period B may be a period in which the threshold voltage of the drive transistor is compensated. The second compensation period C may be a period in which the drive voltage of the organic light emitting element is measured and the data voltage is compensated. The data input period D may be a period in which the compensated data voltage is transferred to the pixels in correspondence to scan signals sequentially provided. The light emitting period E may be a period in which light emission is performed in correspondence to the transferred data voltage. In one embodiment, the reset period A, the first compensation period B, and the light emitting period E may be successively performed.

The second power voltage ELVSS may be set to a high-level voltage from the reset period A to the data input period D. The second power voltage ELVSS of a high level may have substantially the same voltage level as the first power voltage ELVDD of a high level. For example, from the reset period A to the data input period D, the second power voltage ELVSS may be set to a high-level voltage to prevent the drive current from flowing to the organic light emitting element EL. The second power voltage ELVSS may be shifted to a low-level voltage in the light emitting period E, and thus the organic light emitting element EL may emit light based on the drive current of the second transistor T2.

The first power voltage ELVDD may be set to a high-level voltage in the remaining period except for the reset period A. For example, during the reset period A, the first power voltage ELVDD may be applied as a low-level voltage for a predetermined time. In this case, the scan signals S1 to Sn may be applied with a gate-on voltage to turn on the first transistor T1. The gate-on voltage of the scan signals S1 to Sn may be a low-level voltage. Further, a turn-on voltage Von of a predetermined level may be applied to the data line. For example, the turn-on voltage Von may be provided to the first node N1 through the first transistor T1, and may be provided as the gate voltage of the second transistor T2.

During the reset period A, the voltage difference between the first power voltage ELVDD and the second power voltage ELVSS is reversed. Accordingly, the anode electrode voltage of the organic light emitting element EL may become higher than the first power voltage ELVDD of the low level. Also, from the viewpoint of the drive transistor T2, the anode electrode of the organic light emitting element EL may become a source. The gate voltage of the drive transistor T2 may be similar to the first power voltage ELVDD. Also, the anode electrode voltage of the organic light emitting element EL, which is the sum of the second power voltage ELVSS and the voltage (e.g., about 0 to 3V) stored in the organic light emitting element EL, may be much higher than the gate voltage of the drive transistor TR2.

Since the gate-source voltage of the drive transistor TR2 becomes a substantially negative voltage, the drive transistor TR2 may be turned on. In this case, current, which flows through the drive transistor TR2, flows from the anode electrode of the organic light emitting element EL to the first power voltage ELVDD. This current ultimately flows until the anode voltage of the organic light emitting element EL becomes equal to the first power voltage ELVDD of the low level. For example, during the reset period A, a reset operation may be performed to set the anode voltage of the organic light emitting element EL equal to the low-level voltage.

Once the reset operation is completed during the reset period A, the first power voltage ELVDD may be shifted to a high-level voltage.

During the first compensation period B, the scan signals S1 to Sn may be applied as a low-level voltage to turn on the first transistor T1. The compensation control signal GC may be applied as a low-level voltage for a predetermined period to turn on the third transistor T3. A sustain voltage Vsus of a predetermined level may be applied to the data line connected to one electrode of the first transistor T1. The sustain voltage Vsus may be transferred to the first node N1 through the first transistor T1 that is in a turn-on state. As the compensation control signal GC is applied, the third transistor T3 is turned on to set the drive transistor T2 in a diode-connected state. A voltage ELVDD-Vth is obtained by subtracting the threshold voltage Vth of the drive transistor T2 from the first power voltage ELVDD. This voltage ELVDD-Vth is supplied to the gate electrode of the drive transistor T2.

In this case, a voltage Vsus-ELVDD+Vth is charged in the first capacitor C1. The voltage Vsus-ELVDD+Vth is a voltage difference between the sustain voltage Vsus of the first node N1 and the voltage ELVDD-Vth of the second node N2. As described above, during the first compensation period B, the voltage that corresponds to the threshold voltage Vth of the drive transistor T2 may be charged in the first capacitor C1 to perform the compensation operation. When the compensation operation is completed during the compensation period B, the scan signals S1 to Sn and the compensation control signal GC may be shifted to high-level voltages. For example, the first compensation period B may be a period to compensate for the threshold voltage Vth.

FIGS. 5 to 7 are graphs illustrating examples of drive characteristics of drive transistors T2*a* and T2*b* that are arranged in different pixels. As illustrated in FIG. 5, the drive transistors T2*a* and T2*b* have different threshold voltages Vth and different electron mobilities μ. Since the threshold voltage Vth is compensated during the first compensation period B, the drive transistors may have the same threshold voltage. For example, as the threshold voltage Vth is compensated, drive current Ids that flows to the organic light emitting element EL is based on Equation 1.

$$\begin{aligned} Ids &= k(Vgs - Vth)^2 \\ &= k((ELVDD + Vth + Vsus - Vdat) - ELVDD - Vth)^2 \\ &= k(Vsus - Vdat)^2 \end{aligned} \tag{1}$$

In Equation 1, Vdat is a data voltage applied after the threshold voltage is compensated and k is a parameter determined according to the characteristic of the drive transistor to correspond to the electron mobility μ. For example, the drive current Ids may be determined according to the level of the data voltage Vdat regardless of any deviation in threshold voltage Vth. The organic light emitting element EL may emit light with brightness that corresponds to the data voltage Vdat regardless of any deviation of the threshold voltage Vth.

In some embodiments, each pixel may further include a sustain transistor that applies the sustain voltage Vsus to the first node N1. That is, the sustain voltage Vsus may not be provided to the first transistor T1, but may be provided through the sustain transistor. The sustain transistor may be controlled to be turned on/off by the same signal as the scan signal. However, even if the threshold voltage Vth is compensated as described above, the drive transistors T2*a* and T2*b* may have different characteristics according to a deviation in electron mobility μ.

The second compensation period C may be a period in which the deviation of the electron mobility μ is compensated. For example, the second compensation period C may be a period in which a sensing voltage Vgp of a predetermined level is applied, and drive information of the drive transistor T2 is sensed to generate compensation data. In one embodiment, deviation in electron mobility μ may be compensated based on the drive information of the drive transistor T2. The drive information of the drive transistor T2 may be generated, for example, by directly sensing the drive current Igp that is formed according to the sensing voltage Vgp. For example, the drive information of the drive transistor may be generated by sinking the drive current Igp and the data line and measuring the voltage that is formed on the data line.

The second compensation period C may include a sensing voltage applying period C1, a data line initialization period C2, and a sensing period C3. During the sensing voltage applying period C1, the scan signals S1 to Sn may be successively turned on. As a result, the sensing voltage Vgp may be correspondingly applied to the first transistor T1. As the sensing voltage Vgp is applied, the sensing current Igp corresponding to the sensing voltage Vgp may be generated in the second transistor T2. The sensing voltage Vgp may be a data voltage indicative of a predetermined gray level, and may be supplied from the sensing unit 150 as described above.

During the data line initialization period C2, an initialization voltage Vint is applied to the data lines. The sensing voltage Vgp that is accumulated in the data lines may be discharged by the initialization voltage Vint.

During a predetermined period in the sensing period C3, the sensing control signal SE of a low level is applied to turn on the fourth transistor T4. As the fourth transistor T4 is turned on, the initialized data line and the third node Ne may be connected to each other. Further, a current sink unit may be connected to one end of the data line, and the sensing current Igp may flow from the third node N3 to the current sink unit through the data line.

The sensing unit 150 may measure the voltage of the data line that is formed by the sink sensing current Igp. Data measured in each pixel may be a resultant value corresponding to the deviation in electron mobility μ of the drive transistor, of which the threshold voltage Vth is compensated. The sensing unit 150 may convert the analog data voltage measured in each pixel into a digital value. The sensing unit 150 may generate sensing data SD through mapping of the measured digital data, and may provide the generated sensing data SD to the control unit 120. The control unit 120 may compensate the image data DATA using the sensing data SD to generate compensated image data DATA1.

In one embodiment, the control unit 120 includes a signal processing unit 121 generating the first to sixth drive signals CONT1 to CONTE, a video processing unit 122 processing a image signal R, G, and B to generate image data DATA, and an image compensation unit 123 to compensate for image data DATA.

The image compensation unit 123 may generate compensated image data DATA1 using the sensing data SD from the sensing unit 150 and the image data DATA from the video processing unit 122. The compensated image data DATA1 may be data in which deviation in electron mobility μ of the drive transistor T2 is compensated. The image compensation unit 123 may reduce or prevent deviation in electron mobility μ between neighboring drive transistors T2 from occurring by compensating for the image data DATA. As a result, the level of the data voltage applied to the drive transistor T2 of a specific pixel becomes high, e.g., the compensation may be performed so that the drive transistors T2*a* and T2*b* have almost the same drive characteristics as in FIG. 7.

In the second compensation period C, a value that corresponds to the drive current Ids applied to the organic light emitting element EL is directly measured. Thus, any characteristic change that occurs due to deterioration of the organic light emitting element EL may also be sensed. For example, sensing data SD may be data in which a characteristic change due to deterioration of the organic light emitting element EL is reflected. In one embodiment, during the second compensation period C, compensation for deterioration in the organic light emitting element EL may also be performed. The compensated image data DATA1 may be supplied to the data driving unit 130 in order to be converted to a data voltage.

In the data input period D, the scan signals S1 to Sn may be successively applied as a low-level voltage that turns on the first transistor T1. The data voltage may be correspondingly supplied to the first node N1.

In the light emitting period E, the first power voltage ELVDD may be sustained as a high-level voltage and the second power voltage ELVSS may be changed to a low-level voltage. As the second power voltage ELVSS is changed to a low-level voltage, the drive current Ids may flow to the organic light emitting element EL through the drive transistor T2. The drive current Ids may be calculated based on Equation 1. The data voltage Vdat may correspond to a state where deviation in electron mobility μ of the drive transistor T2 is compensated. Thus, luminance deviation of the respective pixels in the display unit 110 may be reduced or prevented, thereby improving display quality.

In the organic light emitting display 10 of this embodiment, since any change caused by the characteristics of the drive transistor and deterioration of the organic light emitting element is compensated in the compensation period, luminance deviation of the respective pixels may be reduced or prevented, thereby improving display quality.

Figure 9:
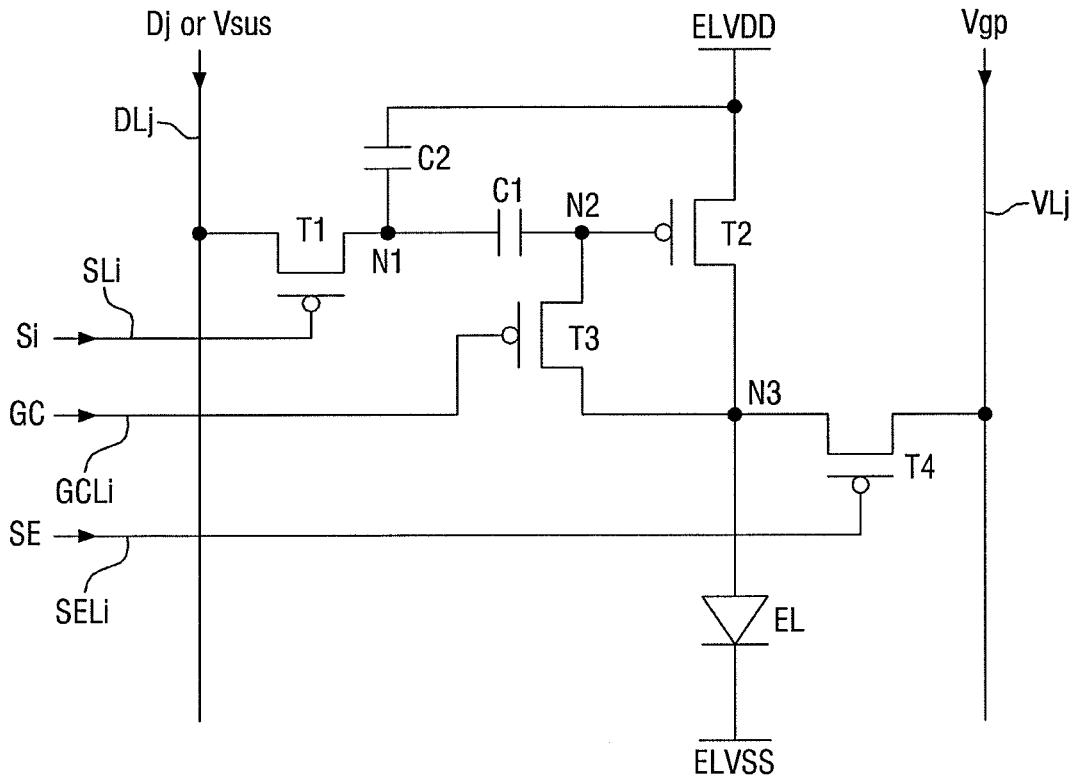
FIG. 9 illustrates another embodiment of a pixel.

FIG. 9 illustrates another embodiment of a pixel of an organic light emitting display 10. This pixel includes a first transistor T1, a second transistor T2, a third transistor T3, a fourth transistor T4, a first capacitor C1, and an organic light emitting element EL. The remaining configuration except for the fourth transistor T4 may be substantially the same as the configuration of the organic light emitting display according to the embodiment of FIGS. 1 to 8.

The fourth transistor T4 has a gate electrode connected to the sensing control line SELi, one electrode connected to the third node N3, and another electrode connected to the sensing line VLj. Thus, the fourth transistor T4 receives the sensing voltage Vgp through a separate sensing line VLj rather than the data line DLj. Further, the drive information of the second transistor may be sensed through the sensing line VLj. For example, one end of the sensing line VLj is connected to a current sink unit, and sensing current Igp according to the sensing voltage Vgp flows along the sensing line VLj to form a predetermined voltage.

The sensing unit 150 measures the voltage that is formed on the sensing line VLj, and converts the analog data voltage measured from each pixel to a digital value. The sensing unit 150 may generate sensing data SD through a mapping of the measured digital data, and may provide the generated sensing data to the control unit 120. Thus, the organic light emitting device may generate more accurate sensing data SD by separately forming the data line and the sensing line without sharing of them.

Figure 10:
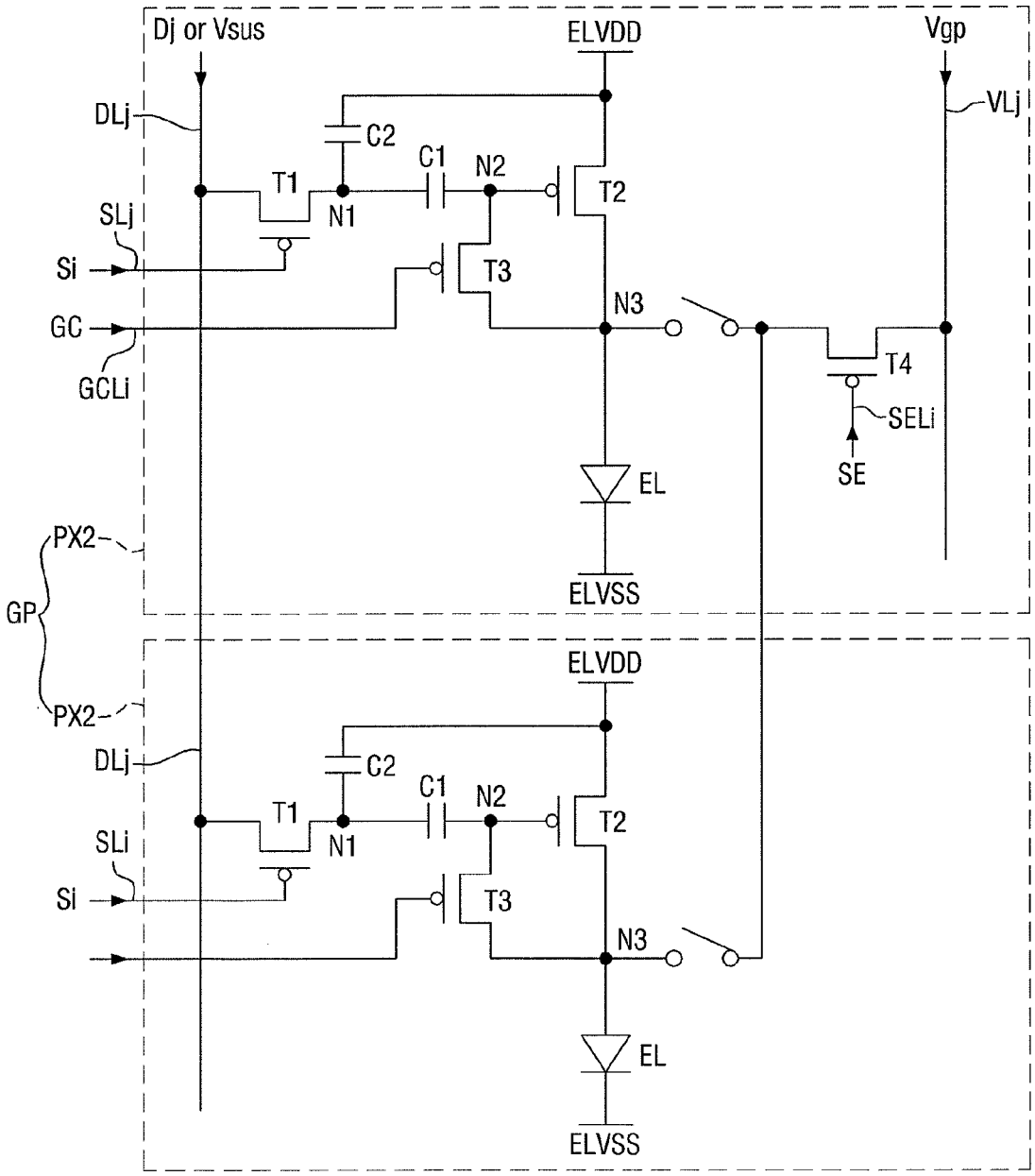
FIG. 10 illustrates another embodiment of an organic light emitting display.

FIG. 10 illustrates another embodiment of a pixel of an organic light emitting display. In this embodiment, a first pixel group PG is defined to include at least two pixels PX1 and PX2 that emit light of different colors. For example, the first pixel group PG may be a unit pixel including sub-pixels emitting red, green, and blue light.

Each of the pixels PX1 and PX2 includes a first transistor T1, a second transistor T2, a third transistor T3, a first capacitor C1, and an organic light emitting element EL. A fourth transistor T4 may be formed in any pixel that is included in the first pixel group PG. The remaining pixels in the first pixel group PG may share the fourth transistor T4. For example, the fourth transistor T4 may only be formed in any pixel of the first pixel group PG, and may perform sensing of not only the generated pixel but also the remaining pixel of the first pixel group PG.

The fourth transistor T4 and the respective pixels in the first pixel group PG may be selectively connected to each other, and drive information of the drive transistors of the connected pixels may be sensed. Other aspects of the organic light emitting display may be substantially the same as the organic light emitting display of FIGS. 1 to 8.

Figure 11:
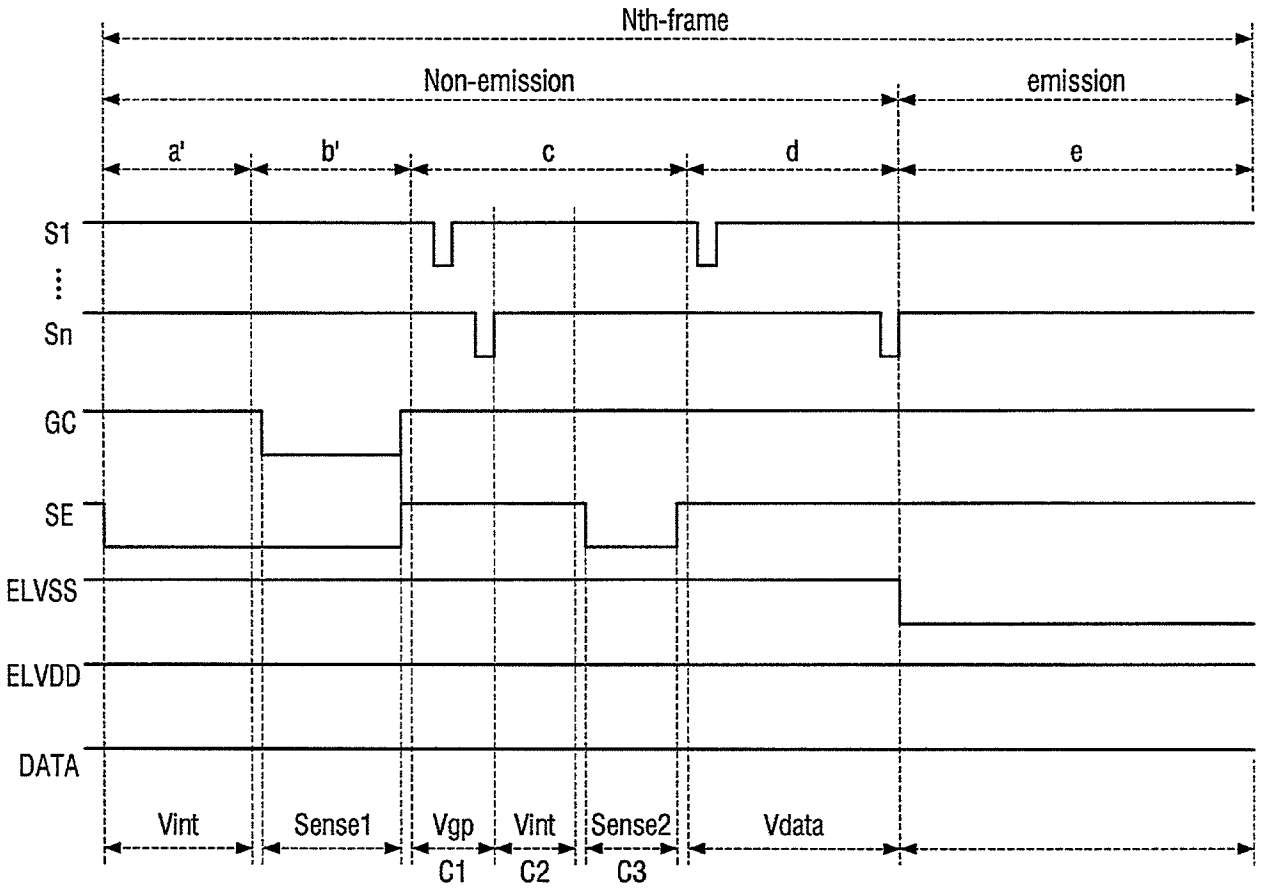
FIG. 11 illustrates another example of control signals for an organic light emitting display.

FIG. 11 is a timing diagram illustrating another example of control signals for driving an organic light emitting display. In the organic light emitting display according to this embodiment, one unit frame period may include a reset period A', a first compensation period B', a second compensation period C, a data input period D, and a light emitting period E. The second compensation period C, the data input period D, and the light emitting period E may be substantially the same as for the organic light emitting display in FIGS. 1 to 8.

The reset period A' may be a period in which the drive voltage of the organic light emitting element is reset. The first compensation period B' may be a period in which the threshold voltage is directly measured through the data line and the sensing data is generated.

The second power voltage ELVSS may be set to a high-level voltage from the reset period A' to the data input period D. The second power voltage ELVSS of a high level may have substantially the same voltage level as the first power voltage ELVDD of a high level. For example, from the reset period A' to the data input period D, the second power voltage ELVSS may be set to a high-level voltage to prevent the drive current from flowing to the organic light emitting element EL. The second power voltage ELVSS may be shifted to a low-level voltage in the light emitting period E. Thus, the organic light emitting element EL may emit light by the generated drive current of the second transistor T2. The first power voltage ELVDD may be set to a high-level voltage in one frame period.

During the reset period A', the scan signals S1 to Sn may be set to high level that corresponds to a gate-off voltage level. The reset period A' may include a predetermined period in which the sensing control signal SE of a low level is provided. For example, during the reset period A', the fourth transistor T4 may be turned on by the sensing signal SE. At the same time, an initialization voltage Vint may be supplied through the data line DLj. The data line DLj, to which the initialization voltage Vint is supplied, and the third node N3, connected to the anode electrode of the organic light emitting element EL, may be connected to each other as the fourth transistor T4 is turned on. The initialization voltage Vint may be a low-level voltage, e.g., 0V. Current may flow to the data line DLj through the fourth transistor T4 until the anode voltage of the organic light emitting element EL becomes equal to the initialization voltage Vint. Thus, during the reset period A', a reset operation may be performed to set the anode voltage of the organic light emitting element EL equal to the low-level voltage.

During the first compensation period B', the compensation control signal GC may be applied as a low-level voltage for a predetermined period to turn on the third transistor T3. As the compensation control signal GC is applied, the third transistor T3 is turned on to place the drive transistor T2 in a diode-connected state. The voltage ELVDD-Vth is obtained by subtracting the threshold voltage Vth of the drive transistor T2 from the first power voltage ELVDD. This voltage ELVDD-Vth may be formed on the gate electrode of the drive transistor T2 and the third node N3.

During the first compensation period B', the sensing control signal SE may be in a low-level state and the fourth transistor T4 may be in a turn-on state. The data line DLj and the fourth node may be in an equipotential state. The sensing unit 150 may sense the voltage of the drive transistor T2 through measurement of the voltage on the data line DLj. Thus, since the first power voltage ELVDD has a constant voltage level, the threshold voltage Vth of the drive transistor T2 may be calculated using the measured voltage value.

The sensing unit 150 may calculate the threshold voltage Vth of each pixel and may convert the calculated threshold voltage into a digital value. The sensing unit 150 may generate first sensing data SD1 through a mapping of the converted digital value, and may store the generated first sensing data in a memory.

During the second compensation period C, the sensing unit 150 may generate second sensing data SD2 in substantially the same method as the method according to FIGS. 1 to 8, and may provide the first sensing data SD1 and the second sensing data SD2 to the control unit 120. The control unit 120 may compensate for the image data DATA using the first sensing data SD1 and the second sensing data SD2, and may generate compensated image data DATA1.

Figure 12:
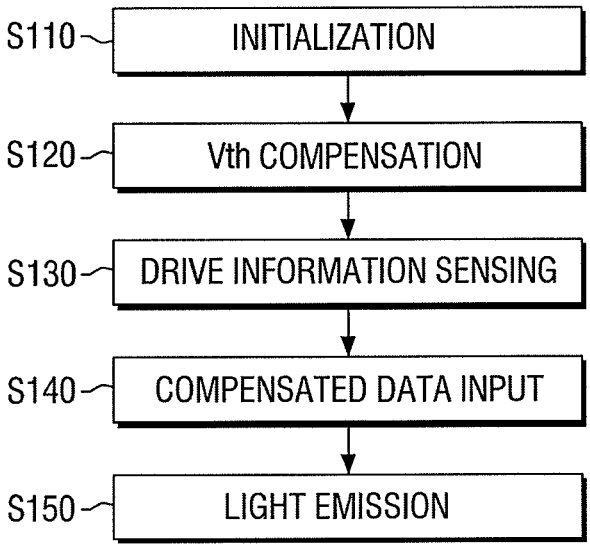
FIG. 12 illustrates an embodiment of a method for driving an organic light emitting display.

FIG. 12 illustrates an embodiment of a method for driving an organic light emitting display. Referring to FIG. 12, the method includes performing an initialization operation (S110), performing a threshold voltage compensation operation (S120), performing a drive information sensing operation (S130), performing a compensated data voltage applying operation (S140), and performing a light emission operation (S150).

The organic light emitting display may include a plurality of pixels, each of which includes a first node N1, a second node, and a third node N3. A data voltage is applied to the first node N through a switching transistor T1, which is turned on by a scan signal of a gate-on voltage. The third node N3 is connected to an anode electrode of an organic light emitting element EL. The second node N2 is connected to the gate electrode of a drive transistor T2, which controls drive current transferred from a first power voltage ELVDD to the third node N3. Each pixel also includes a first capacitor C1 connected between the first node N1 and the second node N2. The organic light emitting display may be, for example, the organic light emitting display corresponding of FIGS. 1 to 11.

During the initialization operation (S110), a voltage of the third node N3 is initialized. The initialization operation may include setting the first power voltage ELVDD to a low level and resetting the voltage level of the third node N3 to a low-level voltage. For example, during initialization, a predetermined turn-on voltage is applied to the drive transistor T2. A second power voltage ELVSS connected to the cathode electrode of the organic light emitting element is at a high-level voltage.

Also, during initialization, the voltage difference between the first power voltage ELVDD and the second power voltage ELVSS may be reversed. Accordingly, the anode electrode voltage of the organic light emitting element EL may become higher than the first power voltage ELVDD of the low level. Thus, from the viewpoint of the drive transistor T2, the anode electrode of the organic light emitting element EL may become a source. The gate voltage of the drive transistor T2 may be similar to the first power voltage ELVDD. The anode electrode voltage of the organic light emitting element EL may be much higher than the gate voltage of the drive transistor TR2. For example, the anode electrode voltage of element EL may correspond to the sum of the second power voltage ELVSS and the voltage (e.g, about 0 to 3V) stored in the organic light emitting element EL.

Since the gate-source voltage of the drive transistor TR2 becomes substantially negative voltage, the drive transistor TR2 may be turned on. In this case, current, which flows through the drive transistor TR2, flows from the anode electrode of the organic light emitting element EL to the first power voltage ELVDD. This current ultimately flows until the anode voltage of the organic light emitting element EL becomes equal to the first power voltage ELVDD of the low level. Thus, the voltage of the third node, which is the anode voltage of the organic light emitting element EL, is initialized to the low-level voltage.

In another embodiment, the initialization (S110) may be performed in a different manner. For example, the third node N3 may be connected to a line to which an initialization voltage Vint is applied, and the voltage of the third node N3 may be discharged to the line. The third node and the line may be connected to each other, for example, through a sense transistor T4. Also, the line to which the initialization voltage is applied may be, for example, a data line. The line to which the initialization voltage is applied may be a separate sense line.

During the threshold voltage compensation operation (S120), the third node N3 and the second node N2 may be connected to each other. Thus, the threshold voltage Vth of the drive transistor T2 may be compensated. For example, during the threshold voltage compensation operation, the compensation transistor T3, which has one electrode connected to the third node N3 and the other electrode connected to the second node N2, may be turned on by a compensation control signal to connect the third node N3 to the second node N2. Accordingly, a voltage (is obtained by subtracting the threshold voltage Vth of the drive transistor T2 from the first power voltage ELVDD) may be charged in the second node N2, and a voltage (obtained by subtracting the voltage that is charged in the second node N2 from the sustain voltage Vsus applied to the first node N1) may be charged in the first capacitor. Thus, the compensation operation may be performed to charge a voltage that corresponds to the threshold voltage Vth of the drive transistor T2 in the first capacitor C1.

In one embodiment, compensating the threshold voltage of the drive transistor may further include generating compensated data based on measurement of the voltage of the third node N3. Since the threshold voltage Vth is reflected in the third node N3, the compensated data may be generated with data obtained by directly sensing the threshold voltage Vth.

During the sensing operation (S130), the sensing unit 150 may sense drive information of the drive transistor T2 based on applying a sensing voltage Vgp of a predetermined level. The sensing voltage Vgp may be supplied, for example, through the data line for applying the data voltage. In another embodiment, the sensing voltage may be supplied through a separate sensing line different from the data line. The drive information of the drive transistor T2 may be generated, for example, by directly sensing drive current Igp that is formed according to the sensing voltage Vgp.

The drive information measured in each pixel may be a resultant value that reflects a deviation in electron mobility μ of the drive transistor, of which the threshold voltage Vth is compensated. The drive information of the drive transistor T2 may be generated, for example, by sinking the drive current Igp and the data line and then measuring the voltage on the data line. In one embodiment, the sensing unit 150 may convert the sensed drive information into a digital value and generate sensing data SD through a mapping operation.

The drive information may be calculated by directly measuring a value that corresponds to the drive current Ids applied to the organic light emitting element EL. Thus, a characteristic change due to deterioration of the organic light emitting element EL may also be sensed. The sensing data SD may be data in which this characteristic change is reflected.

During the compensation operation (S140), the sensing unit 150 may provide the sensing data SD to the control unit 120. The control unit may compensate for the image data DATA using the sensing data SD and may generate the compensated image data DATA1. The compensated image data DATA1 may be data in which deviation of the electron mobility μ of the drive transistor T2 is compensated. For example, the control unit 120 may reduce or prevent deviation in electron mobility μ between the neighboring drive transistors T2 by compensating for the image data DATA. As a result, the level of data voltage applied to the drive transistor T2 of a specific pixel becomes high. The controller 120 may supply the compensated image data DATA1 to the data driving unit 130, and the data driving unit 130 may input the compensated image data DATA1 to each pixel according to the scan signals that are successively provided.

During the light emission operation of the pixel (S150), the first power voltage ELVDD may be set to a high-level voltage and the second power voltage ELVSS may be changed to a low-level voltage. As the second power voltage ELVSS is changed to a low-level voltage, the drive current Ids may flow to the organic light emitting element EL through the drive transistor T2. The drive current Ids may be calculated based on Equation 1. The data voltage Vdat may correspond to a state where deviation in electron mobility μ of the drive transistor T2 is compensated. As a result, luminance deviation of the respective pixels in the display unit 110 may be reduced or prevented.

By way of summation and review, the drive transistors pixels in an organic light emitting display may have different threshold voltages, charge mobilities, and/or other characteristics. Thus, even if the same data voltage is applied to these pixels, the luminance of light emitted from the pixels may be different. Also, the organic light emitting elements in each pixel may deteriorate over time. As a result, the characteristics of the organic light emitting element may change. For example, luminance may reduce over time for a same data voltage. These and other effects may degrade display quality.

In accordance with one or more of the aforementioned embodiments, an organic light emitting display effectively compensates for differences in the characteristics of drive transistors and deterioration of organic light emitting elements to improve display quality.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display, comprising:

a first transistor including a gate electrode connected to a scan line, a first electrode connected to a data line, and a second electrode connected to a first node;

a second transistor including a gate electrode connected to a second node, a first electrode connected to a first power voltage, and a second electrode connected to a third node;

a third transistor including a gate electrode connected to a compensation control line, a first electrode connected to the second node, and a second electrode connected to the third node; and a fourth transistor including a gate electrode connected to a sensing control line, a first electrode connected to the data line, and a second electrode connected to the third node, wherein the display operates based on a unit frame period, the unit frame period including:

a first compensation period in which the third transistor is turned on to compensate a threshold voltage of the second transistor, and a second compensation period in which the fourth transistor is turned on to generate compensated data through sensing of drive information of the second transistor based on a sensing voltage of a predetermined level.

2. The display as claimed in claim 1, the display further including:

a first capacitor including a first electrode connected to the first node and a second electrode connected to the second node; and an organic light emitting element including an anode electrode connected to the third node and a cathode electrode connected to a second power voltage.

3. The display as claimed in claim 2, wherein the drive information of the second transistor is to be generated by:

sinking sensing current formed in the second transistor based on the sensing voltage through the data line, and measuring a voltage on the data line.

4. The display as claimed in claim 2, wherein the drive information of the second transistor is generated by directly measuring sensing current formed in the second transistor based on the sensing voltage.

5. The display as claimed in claim 2, wherein:

the second node is to be charged to a voltage based on a difference between the threshold voltage of the second transistor and the first power voltage during the first compensation period, and the first capacitor is to be charged to a voltage based on a difference between a sustain voltage from the data line and the voltage of the second node.

6. The display as claimed in claim 2, wherein the unit frame period includes:

a reset period in which the first power voltage is set to a low-level voltage and a voltage level of the third node is reset by the low-level voltage;

a data input period in which a data voltage according to the compensated data is input; and a light emitting period in which the organic light emitting element emits light according to the input data.

7. The display as claimed in claim 2, further comprising:

a sensor to sense the drive information of the second transistor and to generate the compensated data; and a controller to compensate for image data based on data from the sensor.

8. The display as claimed in claim 2, further comprising:

a first pixel group that includes a plurality of pixels including two pixels, wherein each of the two pixels includes at least the first transistor, the first capacitor, the second transistor, the third transistor, and the organic light emitting element, wherein the fourth transistor is in any one pixel of the first pixel group, and wherein a number of pixels in the first pixel group share the fourth transistor.

9. The display as claimed in claim 1, wherein the fourth transistor is turned on to generate compensated data through measurement of a voltage of the third node in the first compensation period.

10. The display as claimed in claim 9, wherein the unit frame period includes a reset period in which an initialization voltage is applied to the data line, and wherein the fourth transistor is turned on to reset a voltage of the third node.

11. An organic light emitting display, comprising:

a first transistor including a gate electrode connected to a scan line, a first electrode connected to a data line, and a second electrode connected to a first node;

a first capacitor including a first electrode connected to the first node and a second electrode connected to a second node;

a second transistor including a gate electrode connected to the second node, a first electrode connected to a first power voltage, and a second electrode connected to a third node;

a third transistor including a gate electrode connected to a compensation control line, a first electrode connected to the second node, and a second electrode connected to the third node;

a fourth transistor including a gate electrode connected to a sensing control line, a first electrode connected to the third node, and a second electrode connected to a sensing line; and an organic light emitting element including an anode electrode connected to the third node and a cathode electrode connected to a second power voltage.

12. The display as claimed in claim 11, wherein:

the display operates based on one unit frame period, and the one unit frame period includes:

a first compensation period in which the third transistor is turned on to compensate for a threshold voltage of the second transistor, and a second compensation period in which the fourth transistor is turned on to generate compensated data through sensing drive information of the second transistor based on a sensing voltage of a predetermined level.

13. The display as claimed in claim 12, wherein the drive information of the second transistor is generated by:

sinking drive current formed in the second transistor through the sensing line based on the sensing voltage, and measuring a voltage formed on the sensing line.

14. The display as claimed in claim 11, further comprising:

a first pixel group including a plurality of pixels including two pixels, wherein each of the two pixels includes at least the first transistor, the first capacitor, the second transistor, the third transistor, and the organic light emitting element, wherein the fourth transistor is in any one pixel of the first pixel group, and wherein a number of pixels of the first pixel group share the fourth transistor.

15. A method for driving an organic light emitting display, the display including a plurality of pixels, each of the pixels including a first node to which a data voltage is applied through a switching transistor that is turned on by a scan signal of a gate-on voltage, a third node connected to an anode electrode of an organic light emitting element, a second node connected to a gate electrode of a drive transistor that controls drive current transferred from a first power voltage to the third node, and a first capacitor connected between the first node and the second node, the method comprising:

initializing a voltage of the third node;

compensating a threshold voltage of the drive transistor by connecting the third node to the second node;

applying a sensing voltage to the first node and sensing drive information of the drive transistor based on sensing current formed at the third node by the sensing voltage; and applying a data voltage according to compensated image data in which the sensed drive information is reflected, wherein the organic light emitting element emits light based on the applied data voltage.

16. The method as claimed in claim 15, wherein compensating the threshold voltage of the drive transistor includes:

charging the second node to a voltage which corresponds to a difference between the threshold voltage of a second transistor and the first power voltage, and charging a voltage in the first capacitor which corresponds to a voltage difference between a sustain voltage and the voltage charged to the second node.

17. The method as claimed in claim 15, wherein compensating the threshold voltage of the drive transistor includes generating compensated data based on the voltage of the third node.

18. The method as claimed in claim 17, wherein initializing the voltage of the third node includes:

connecting the third node to a line to which an initialization voltage is applied, and discharging the voltage of the third node to the line.

19. The method as claimed in claim 15, further comprising:

supplying the sensing voltage through a data line to which the data voltage is applied.

20. The method as claimed in claim 15, further comprising:

supplying the sensing voltage through a sensing line different from a data line to which the data voltage is applied.

* * * * *